United States Patent [19]

Said et al.

[11] Patent Number: 4,998,610

[45] Date of Patent: Mar. 12, 1991

[54] COIN DETECTOR AND COUNTER

[76] Inventors: Adil S. Said, 4341 Southern, Dallas, Tex. 75205; Leo J. Higdon, 4214 U.S. Hwy. 80, Apt. 2045, Mesquite, Tex. 75149

[21] Appl. No.: 245,519

[22] Filed: Sep. 19, 1988

[51] Int. Cl.[5] ..... G07D 5/08

[52] U.S. Cl. ..... 194/318; 73/163; 232/7

[58] Field of Search ..... 194/317, 318, 319, 334; 73/163; 324/234, 239, 262; 232/7, 9, 15, 16

[56] References Cited

U.S. PATENT DOCUMENTS

| | | | |
|---|---|---|---|
| 3,576,244 | 4/1971 | Ptacek et al. | 194/318 |
| 3,667,485 | 6/1972 | Sesko | 232/7 X |
| 4,086,527 | 4/1978 | Cadot | 324/239 X |
| 4,353,453 | 10/1982 | Partin et al. | 73/163 X |
| 4,361,218 | 11/1982 | Van Dort | 73/163 X |
| 4,371,073 | 2/1983 | Dubey | 73/163 X |
| 4,493,411 | 1/1985 | Heiman | 194/318 |
| 4,660,705 | 4/1987 | Kai et al. | 194/318 |
| 4,717,006 | 1/1988 | Chapman et al. | 194/318 |
| 4,842,119 | 6/1989 | Abe | 194/317 |

FOREIGN PATENT DOCUMENTS

| | | | |
|---|---|---|---|
| 2086633 | 5/1982 | United Kingdom | 194/318 |
| 87-02809 | 5/1987 | World Int. Prop. O. | 194/318 |
| 89-01209 | 2/1989 | World Int. Prop. O. | 194/318 |

*Primary Examiner*—H. Grant Skaggs
*Assistant Examiner*—Steve Reiss
*Attorney, Agent, or Firm*—Gary C. Honeycutt

[57] ABSTRACT

A coin detector and counter comprising a coreless oblong transmitter coil and a coreless oblong receiver coil spaced apart on opposite sides of a coin path arranged to cause the entire diameter of each coin to pass between the coils. The maximum peak voltage generated in the receiver coil upon passage of each coin is measured as a determination of the conductance of each coin. By comparing the measured conductance of each coin with the known conductance of coins, each coin is thereby identified and counted.

11 Claims, 5 Drawing Sheets

COIN DETECTOR AND COUNTER

This invention relates to the identification of selected objects within an assorted collection of related and/or unrelated objects, based on the different ability of each successive object to reduce the intensity of an electromagnetic field. More particularly, the invention relates to the identification of coins by passing assorted collections of coins and/or other objects through an electromagnetic field, and measuring the different degrees of reduction in field intensity caused by each coin or other object as it traverses the field.

Fare boxes, vending machines, and other coin counters have previously been designed to distinguish coins by sensitive mechanical, electrical and/or electromechanical and optoelectric devices for measuring weight, diameter, and other coin characteristics. The complexity and sensitivity of such prior devices have caused them to be somewhat unreliable because they are too readily jammed by foreign objects such as screws, washers, slugs and other debris maliciously inserted into coin slots.

One object of this invention is to provide a system for coin identification that does not require close tolerances, and therefore cannot be so readily jammed as prior systems.

Another object is to provide a system that cannot readily be fooled by objects designed to simulate coins.

The system of this invention is also much simpler and less expensive than prior systems. One reason is that the path of each coin need not be carefully controlled, as in prior systems.

Several prior systems for coin identification have included the use of a transmitter coil on one side of the coin and a receiver coil on the other side. Various input voltages and frequencies have been connected to the transmitter coil, and various analytical treatments of the output signal from the receiver coil have been tried.

For example, U.S. Pat. No. 4,493,411 covers a "Self Tuning Low Frequency Phase Shift Coin Examination Method And Apparatus" wherein coin identification is achieved by measuring the phase shift between the transmitted signal and the received signal, and then comparing the measured shift with prerecorded phase shift data for coin of known identity.

U.S. Pat. No. 4,086,527 is similar, except that a variable frequency input is connected to the transmitter coil, and the output from the receiver is measured at several different frequencies. Since several frequency-dependent tests are contemplated, each coin would have to be held in the field for whatever time period is necessary for that purpose.

Such systems require phase-shift comparisons because they are designed to measure the capacitance of each coin, as an indication of its denomination. However, the capacitance of one coin does not differ from that of a different coin to as great a degree as conductance differs from one coin to another. Thus, the present invention recognizes that it is necessary to test for conductance as the primary or sole indication of the identity of a coin being tested.

The system of the invention allows voltage differences in the output signal from the receiving coil to be measured as the primary or sole basis for coin identification. Because of the novel geometry of the coils, such voltage differences are indicative of the conductance of the whole coin; not just the conductivity of the alloy composition used to fabricate the coin.

In a prefered embodiment, each coil of the invention is wound on a substantially rectangular base, such that the width of each coil is slightly less than the diameter of a dime, and the length of each coil is slightly greater than the diameter of a half-dollar.

The dime and half-dollar are selected because they are the smallest and the largest coin in the assortment to be tested. When other coin sets are to be counted, the preferred coil width is substantially equal to the diameter of the smallest coin, and the coil length is substantially equal to the diameter of the largest.

The transmitter coil is placed on one side of the coin path, and the receiver coil is placed on the opposite side. Each coil is arranged such that the windings lie substantially in a plane parallel to the coin path, and the length of each coil is perpendicular to the coin path. Thus, each coin passes between the coils in a direction that traverses the field from one side of the coils to the other side.

When the center of a dime reaches the center of the field it momentarily fills substantially the entire width of the field, and therefore the field "sees" only the dime at that instant, and not any significant portion of the coin ahead of it or behind it in the coin path. Each larger coin also interacts with the field across its entire diameter only at the moment its center passes the center of the field, because the length of the coils is substantially equal to or slightly greater than the diameter of the largest coin.

Circular coils are not suitable because a dime-sized coil pair could never effectively test a larger coin, and a half-dollar-sized coil pair would frequently interact with more than one coin at a time.

The system of the invention reliably identifies and counts each coin as it passes through the field, regardless of the rate of motion of the coins, which pass through the field in a steady stream, or in an intermittent stream, such as in a fare box, for example. No mechanism is required to control the position or speed of coins as they pass through. This greatly simplifies the coin handling apparatus required for feeding coin through the field. The only requirement is that no two coins be allowed to overlap within the space between the coils.

Figure 2:
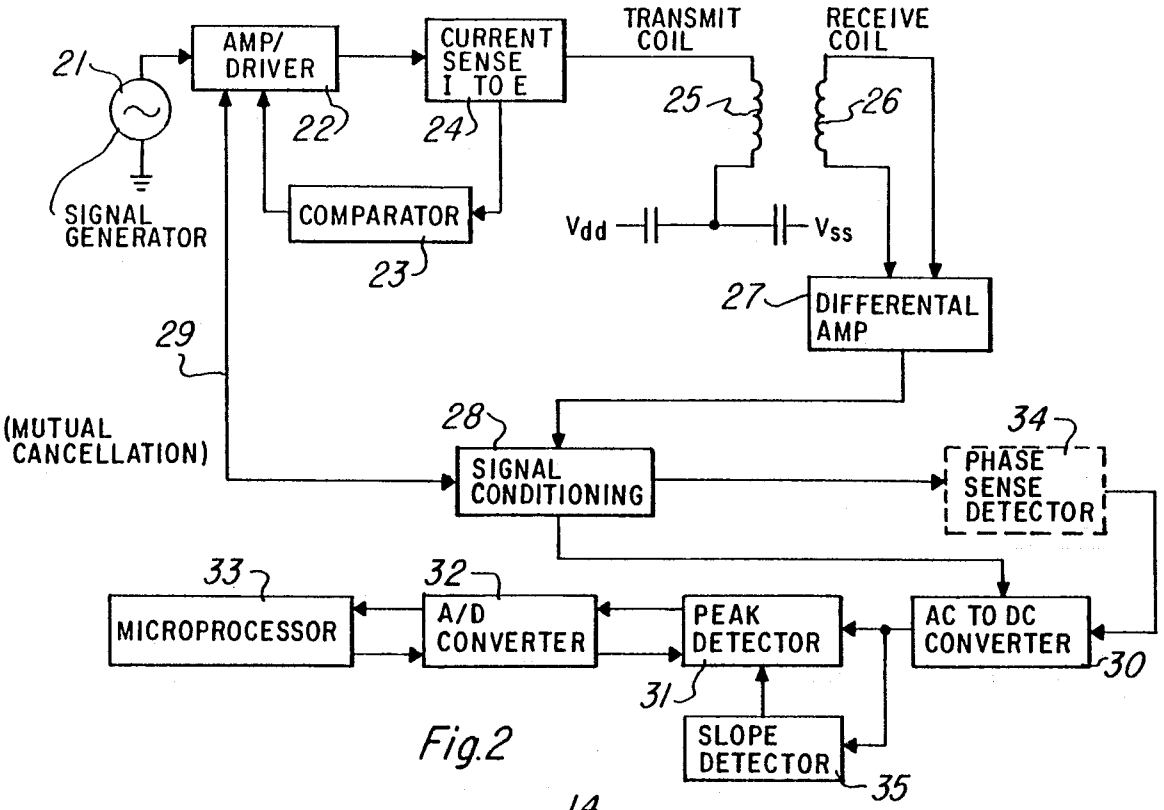
FIG. 2 is a block diagram of the preferred embodiment of the invention.

FIGS. 3–6 in combination are a circuit diagram of the system shown in FIG. 2.

Figure 1:
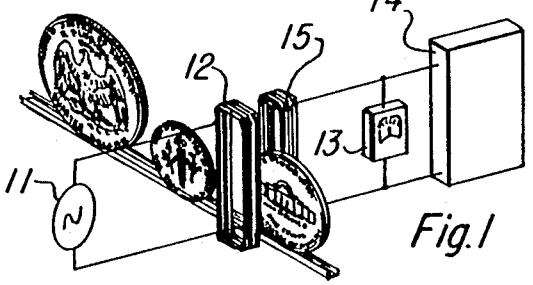
FIG. 1 is a schematic view of the inventive concept.
Figure 3:
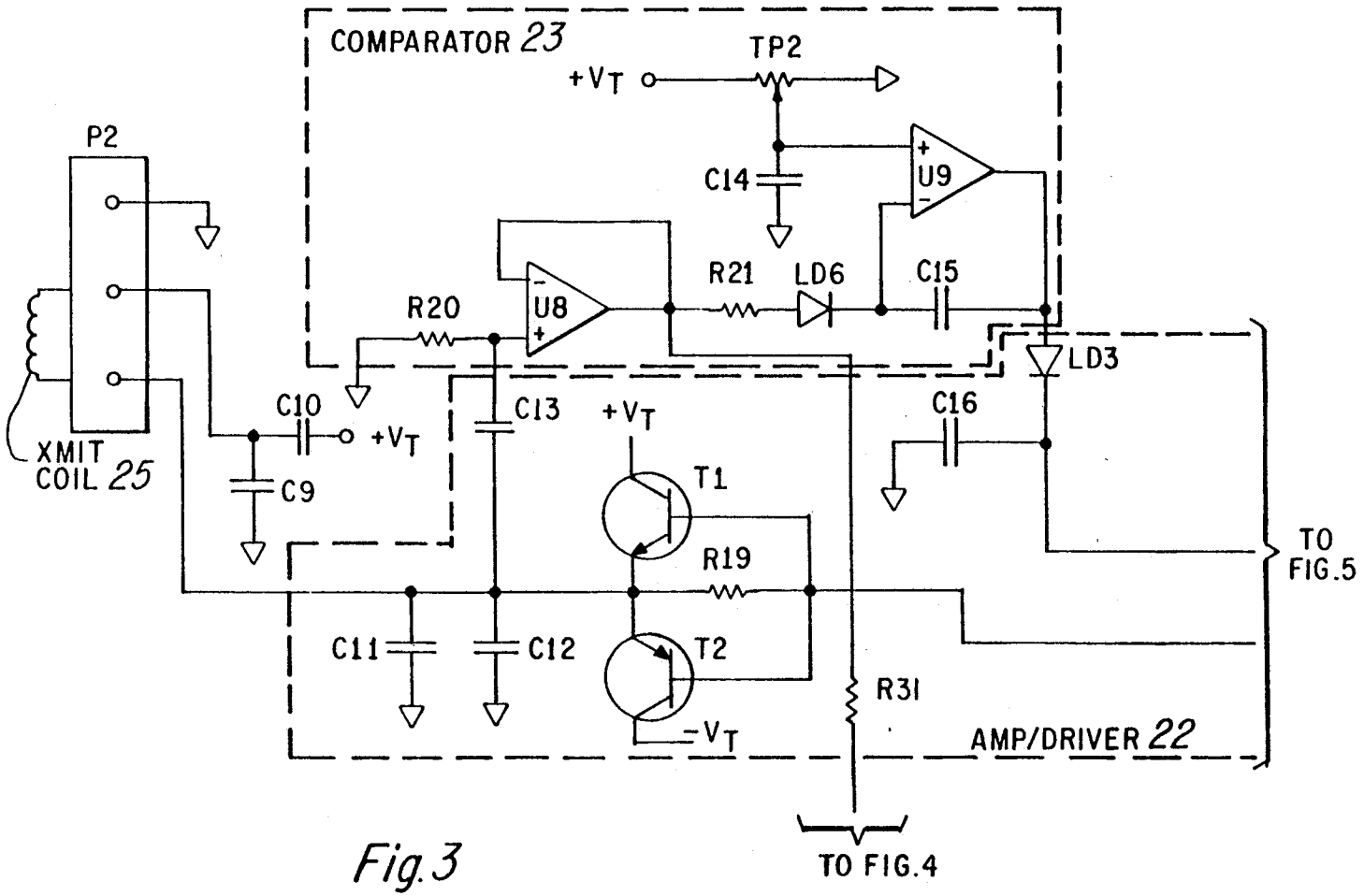
Figure 4:
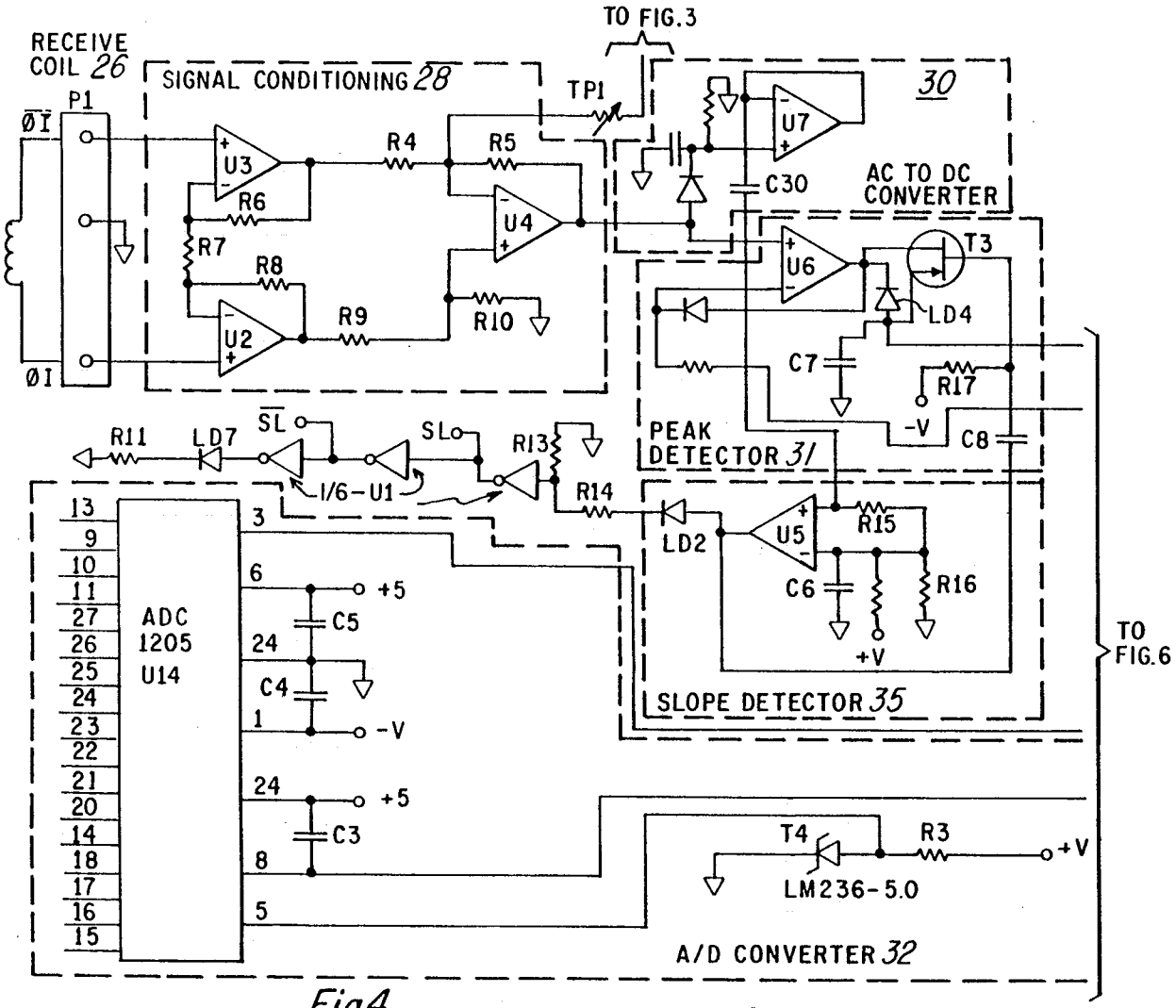
Figure 5:
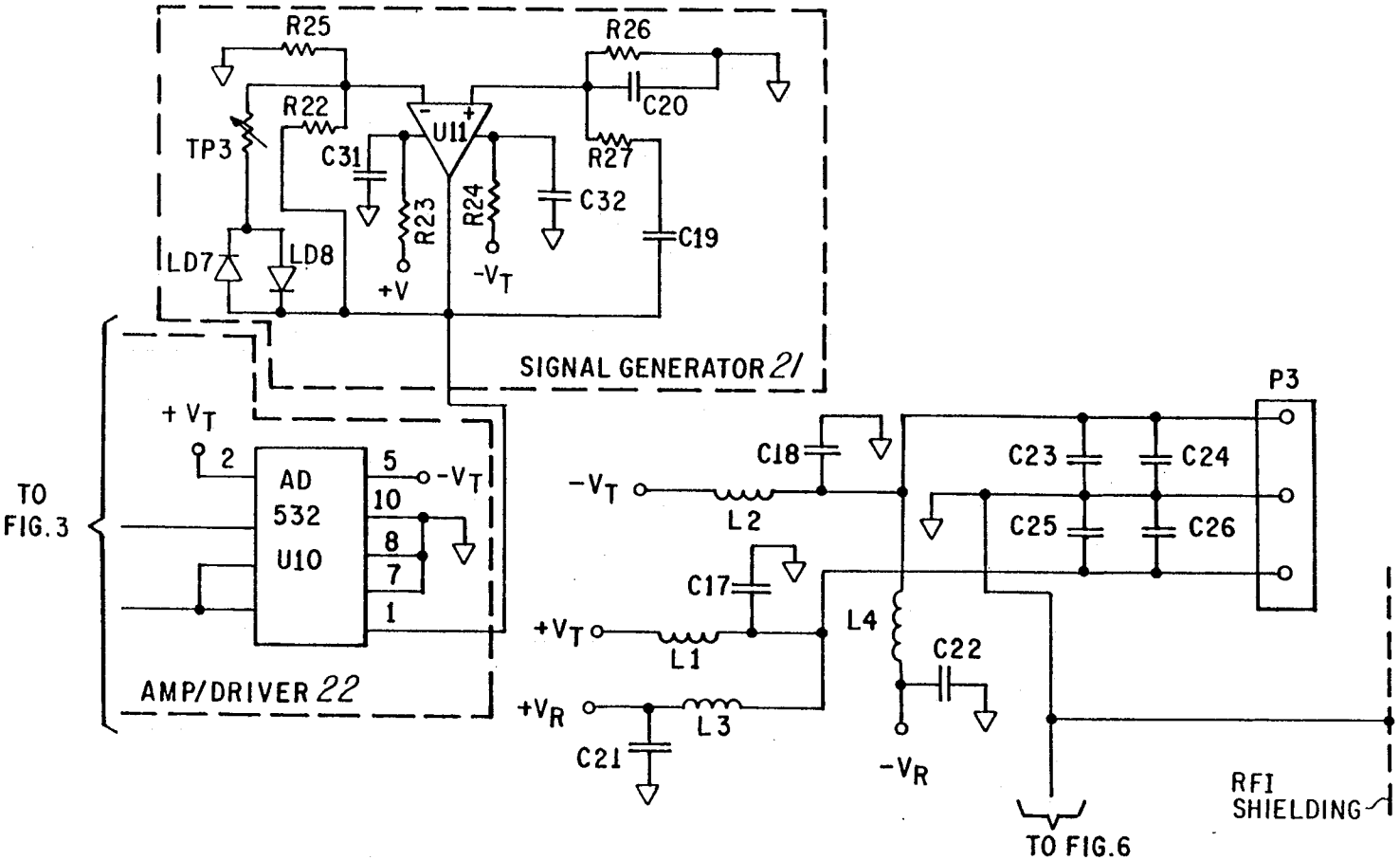
Figure 6:
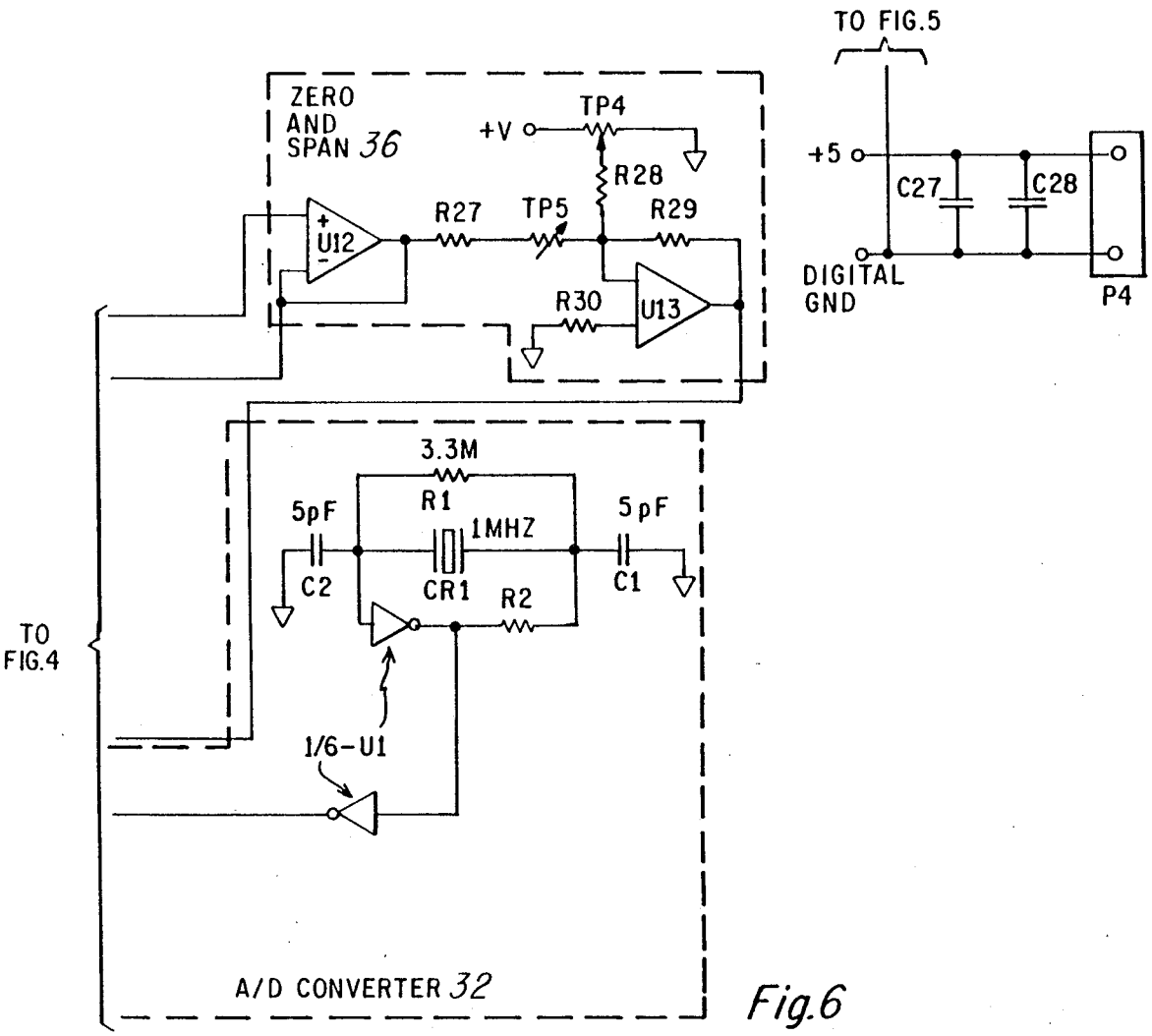

As shown in FIG. 1, the simplest example of the invention consists of an a.c. source 11 connected to transmitter coil 12, and a volt meter 13 and/or an oscilloscope 14 connected to receiver coil 15. The coin path between coils 12 and 15 cuts across the width of the coils, i.e., at an angle to the plane of the paper. The distance between the coils must be slightly greater than the thickness of the thickest coin to be counted. Preferably the distance between the coils is three to five times greater than the minimum required, so that the chance of jamming the slot is minimized.

Each coil is wound on an oblong base, which may be either oval-shaped or rectangular. The dimensions of each coil are selected such that the diameter of the smallest coin to be counted, a dime for example, is slightly greater than the width of each coil, and the diameter of the largest coin, a half dollar for example, is slightly less than the length of each coil. The coils are coaxial and aligned such that all corresponding sides are parallel to each other.

An assortment of coins to be counted is passed one at a time between the coils. No control of coin speed or position is require except that the full diameter of each coin must pass between the coils.

In FIG. 2 signal generator 21 is a Wein Bridge oscillator, tuned for example to 80 khz. Amplifier/driver circuit 22 consists of a four quadrant multiplier and a push-pull amplifier of known design.

Comparator 23 in combination with circuit 22 provides an output to the transmitter coil having a constant peak-to-peak value.

The transmitter coil 25 and the receiver coil 26 consist of 30 gauge wire wound on a plexiglass base measuring ¼ inch by 1¼ inch. Each coil has about 300 turns of wire which adds to the width and length of the base, resulting in a coil width of ⅝ inch and a length of 1½ inch.

The output from coil 26 is passed to differential amplifier 27 and conditioner 28 where signal 29 from circuit 22 is summed therewith to null out quadrature and leave as a remainder only the signal generated by each passing coin. The positive average of this signal is then converted at circuit 30 to direct current and passed to negative peak detector 31. The conditioned d.c. signal is then converted at 32 to binary numbers for transmission to microprocessor 33. The microprocessor is programmed to compare the incoming signals with prerecorded values for coins of known denomination, so that the identity of each coin is thereby determined. The money value of the coins is totalled to provide a final read-out or display.

FIGS. 3–6 in combination show the details of the system of FIG. 2. Signal generator 21 consists of opamp U11 and associated resistors, capacitors and diodes shown in FIG. 5.

Amp/driver 22 includes an Analog Devices circuit AD532 (U10), which is a four quadrant multiplier, operating to multiply the sine wave output of U11 and the DC signal from circuit U9 of comparator 23. The output from 22 is passed to opamp U8, a DC blocking high pass active filter which, in combination with R21 and LD6 passes a DC value to U9 that equals the most positive level of the AC output at U8. U9 produces a highly filtered DC value which holds the output to the transmitter coil at a consistent peak-to-peak voltage.

Differential amplifier 27 is composed of U2, U3 and U4. U4 sums the signal from U3 and from U8 to null out quadrature, leaving essentially the signal generated by passing coins at the output of U4.

U7 together with LD5, R18 and C29 follows the positive average of the AC output from U4. U6, U12 and associated circuitry form negative peak detector 31. This voltage is stored in C7.

Opamp U13 provides offset and gain adjustments for the input to U14. The U5 output indicates large slope direction on the input envelope. The positive edge of the square wave output of U5 turns T3 on, discharging C7. The negative edge starts the conversion of the analog to digital converter, U14, providing at pin 3 a binary number readily accessible to a computer.

The voltages generated in this system by U.S. coins as they pass between the coils are as follows:

| U.S. Coin | Voltage |
|---|---|
| Dime | 2.40 |
| Penny | 2.95 |
| Nickel | 3.68 |
| Quarter | 5.31 |
| Half-Dollar | 7.57 |

These values are the maximum peak voltages generated by each coin. These characteristic voltages are detected and displayed as the corresponding money value for each coin.

In order to stabilize the system against temperature changes, resistors are chosen which have a thermal coefficient of ±1%.

For purposes of this disclosure, an "oblong" coil is defined as having a length at least 10% greater than its width, and preferably at least 20% greater. A ratio of length to width as great as 4:1 is suitable, while even larger would also be operable.

Various coin handling mechanisms are commercially available for generating a sequential flow of mixed coins, so that only one coin at a time passes between the coils. For example, Block & Company, Inc. of Wheeling, Ill. has Models 101-0065 and 101-0066.

An example of a suitable microprocessor for use in the system of the invention is the Hitachi HD64180 8-bit CMOS device. Operation of the device is explained in their User's Manual #U77, dated Oct. 1985.

The compatible ADC1205 A/D converter is available from National Semiconductor Corporation.

Many other signal processing systems are capable of reading and displaying the characteristic voltages generated in the receiver coil of the invention. The circuitry described herein is presented as one example of a suitable arrangement.

What is claimed is:

1. An apparatus for differentiating the conductance of various coins comprising means for generating an electromagnetic field, means for passing said coins sequentially through said field, and means for detecting the maximum peak voltage in said field caused by each of said coins, as a measure of its conductance, said detecting means comprising a coreless oblong electric coil, the length of said coil being perpendicular to the path of said coins, and the width thereof being no greater than the smallest diameter of a coin to be passed.

2. Apparatus as in claim 1 wherein said means for generating an electromagnetic field comprises an alternating current source connected to a second coreless electric coil having the same dimensions as said detecting coil, and also located perpendicular to the path of said coins, on the side of said path opposite that of said detecting coil.

3. Apparatus as in claim 2 wherein said oblong coil is in said field and spaced apart from said second coil.

4. Apparatus as in claim 3 wherein said means for passing coins through said field comprises a chute for directing said coins between said coils, positioned to direct the entire diameter of each object between said coils.

5. Apparatus as in claim 3 wherein both coils are shaped to form an elongated rectangle, and they are located on opposite sides of the path chosen for said objects.

6. A fare box for a mass transit vehicle comprising means for guiding coins placed therein, means for generating an electromagnetic field in the path of said coins, and an elongated coreless coil for detecting voltage changes in said field caused by each coin as it passes through said field, in order to identify each coin, the length of said coil being perpendicular to the path of said coins, and the width thereof being no greater than the diameter of the smallest coin to be passed.

7. A fare box as in claim 6 wherein said means for generating an electromagnetic field comprises a current source and a second elongated electric coil.

8. A fare box as in claim 7 wherein said first elongated coil is in said field and spaced apart from said second coil such that the entire diameter of each coin passes between the coils.

9. A fare box as in claim 8 wherein said coils are on opposite sides of each coin as it traverses the field.

10. A coin discriminator comprising a first electric circuit including a coreless oblong transmitter coil and a source of alternating current connected to said transmitter coil;

a second electric circuit, separate from said first circuit, including a coreless oblong receiver coil positioned within the field generated by said transmitter coil;

means for passing coins sequentially between said transmitter coil and said receiver coil such that the entire diameter of each coin passes between said coils; and means for measuring the maximum peak voltage generated in said receiver coil by each coin as it passes between the coils;

wherein the longer dimension of each coil exceeds the diameter of the largest coin, and the shorter dimension of each coil is less than the diameter of the smallest coin.

11. A coin discriminator as in claim 10 wherein said alternating current source is tuned to 80 khz.

* * * * *